US008760131B2

(12) United States Patent
van Ettinger et al.

(10) Patent No.: US 8,760,131 B2
(45) Date of Patent: Jun. 24, 2014

(54) HIGH BANDWIDTH PSRR POWER SUPPLY REGULATOR

(75) Inventors: Rudolf Gerardus van Ettinger, Bathgate (GB); Paul Wilson, Linlithgow (GB)

(73) Assignee: Micrel, Inc., San Jose, CA (US)

( * ) Notice: Subject to any disclaimer, the term of this patent is extended or adjusted under 35 U.S.C. 154(b) by 106 days.

(21) Appl. No.: 13/344,909

(22) Filed: Jan. 6, 2012

(65) Prior Publication Data

US 2013/0176006 A1 Jul. 11, 2013

(51) Int. Cl.

| | |
|---|---|
| ***G05F 1/56*** | (2006.01) |
| ***G05F 1/00*** | (2006.01) |
| ***G05F 1/40*** | (2006.01) |
| ***G05F 1/10*** | (2006.01) |

(52) U.S. Cl.
USPC ..... 323/265; 323/286; 323/281; 323/278

(58) Field of Classification Search
USPC ..... 323/265, 271, 273, 274, 275, 279, 280, 323/281
See application file for complete search history.

(56) References Cited

U.S. PATENT DOCUMENTS

| | | | | |
|---|---|---|---|---|
| 5,825,165 | A * | 10/1998 | Kitching et al. | 323/282 |
| 6,246,221 | B1 * | 6/2001 | Xi | 323/280 |
| 6,567,521 | B1 | 5/2003 | Hein | |
| 6,600,299 | B2 * | 7/2003 | Xi | 323/280 |
| 6,710,583 | B2 * | 3/2004 | Stanescu et al. | 323/280 |
| 6,937,847 | B2 * | 8/2005 | Ehrenreich et al. | 455/115.1 |
| 6,989,660 | B2 | 1/2006 | Mauthe | |
| 7,482,791 | B2 * | 1/2009 | Stoichita et al. | 323/271 |
| 7,598,716 | B2 * | 10/2009 | Schlueter et al. | 323/280 |
| 7,733,180 | B1 * | 6/2010 | Tadeparthy et al. | 330/260 |
| 2011/0156670 | A1 * | 6/2011 | Tadeparthy et al. | 323/273 |
| 2011/0156819 | A1 | 6/2011 | Kim et al. | |

* cited by examiner

*Primary Examiner* — Gary L Laxton
*Assistant Examiner* — Trinh Dang
(74) *Attorney, Agent, or Firm* — Van Pelt, Yi & James LLP

(57) ABSTRACT

A voltage regulator includes a power device formed by an NMOS transistor having a drain terminal coupled to an input voltage, a source terminal providing an output voltage and a gate terminal receiving a gate drive signal; and an integrated AC/DC control loop configured to access the output voltage and to generate the gate drive signal based on a value of the output voltage in relation to a first reference voltage and a second reference voltage. The AC control portion generates a gate drive control signal which is AC coupled to the gate terminal of the power device as an AC component of the gate drive signal. The DC control portion controls a DC voltage level of the gate drive signal. The AC control portion is powered by the input voltage while the DC control portion is powered by a high supply voltage greater than the input voltage.

10 Claims, 2 Drawing Sheets

HIGH BANDWIDTH PSRR POWER SUPPLY REGULATOR

FIELD OF THE INVENTION

The invention relates to power supply regulators or voltage regulators and, in particular, to a power supply regulator with high bandwidth power supply rejection ratio (PSRR).

DESCRIPTION OF THE RELATED ART

A power supply regulator for regulating a positive power supply rail is typically implemented using an NMOS or PMOS transistor device as the power device. NMOS transistors are preferred because of its low output impedance as a result of the transistor's transconductance ($g_m$). Low output impedance means that only small corrections on the gate voltage are needed to maintain regulation from disturbances on the power supply voltage (or the input voltage (Vin)) or disturbances from the output voltage (Vout) driving the load. Even when the gain of the correction loop reduces, for instance, at frequencies beyond the dominant pole of the loop, the output voltage is still better regulated as compared to an equivalent PMOS device.

The downside of using an NMOS device as the power device is that to obtain a small Vin-Vout voltage drop to improve efficiency, the gate voltage of the NMOS device has to be driven higher than the power supply voltage Vin. If a voltage larger than the power supply voltage is not available, then a charge pump is used to generate the needed voltage value for the gate voltage. Charge pump circuits generally do not provide much current and tend to be very energy inefficient. However, to achieve sufficiently high frequency voltage regulation, that is, high PSRR, a relatively high drive current is required to drive the gate of the NMOS power device. The requirement for a high gate drive voltage and the requirement for a high gate drive current are contradictory to each other, rendering the use of charge pump circuits to drive the gate terminal of an NMOS power device unsatisfactory.

SUMMARY OF THE INVENTION

According to one embodiment of the present invention, a voltage regulator receiving an input voltage and generating an output voltage includes a power device including an NMOS transistor having a drain terminal coupled to the input voltage, a source terminal providing the output voltage and a gate terminal receiving a gate drive signal; and an integrated AC/DC control loop configured to access the output voltage and to generate the gate drive signal based on a value of the output voltage in relation to a first reference voltage and a second reference voltage. The integrated AC/DC control loop comprising an AC control portion and a DC control portion. The AC control portion is configured to access a difference between a voltage indicative of the output voltage and a first reference voltage where the AC control portion generates a gate drive control signal, the gate drive control signal is AC coupled to the gate terminal of the power device as an AC component of the gate drive signal and the AC control portion is powered by the input voltage. The DC control portion is configured to access a difference between the gate drive control signal and a second reference voltage where the DC control portion controls a DC voltage level of the gate drive signal and the DC control portion is powered by a high supply voltage greater than the input voltage.

The present invention is better understood upon consideration of the detailed description below and the accompanying drawings.

DETAILED DESCRIPTION OF THE PREFERRED EMBODIMENTS

In accordance with the principles of the present invention, a voltage regulator receiving an input voltage implements an integrated AC/DC control loop with AC coupling to drive the gate terminal of an NMOS power device to provide regulation of an output voltage. More specifically, the AC control portion supplying the AC component of the gate drive signal is powered from the input voltage while the DC control portion supplying the DC gate drive voltage level is powered from a low power charge pump. In this manner, the voltage regulator realizes a high power supply rejection ratio (PSRR), both in ratio value and in bandwidth, and the high PSRR is obtained at a low input-output voltage drop and relatively low power supply consumption. Furthermore, high bandwidth of operation is realized by filtering the high frequency noise in the input voltage. The voltage regulator of the present invention obviates the need for large filter inductors which are impractical in implementation, particularly in mobile devices.

Figure 1:
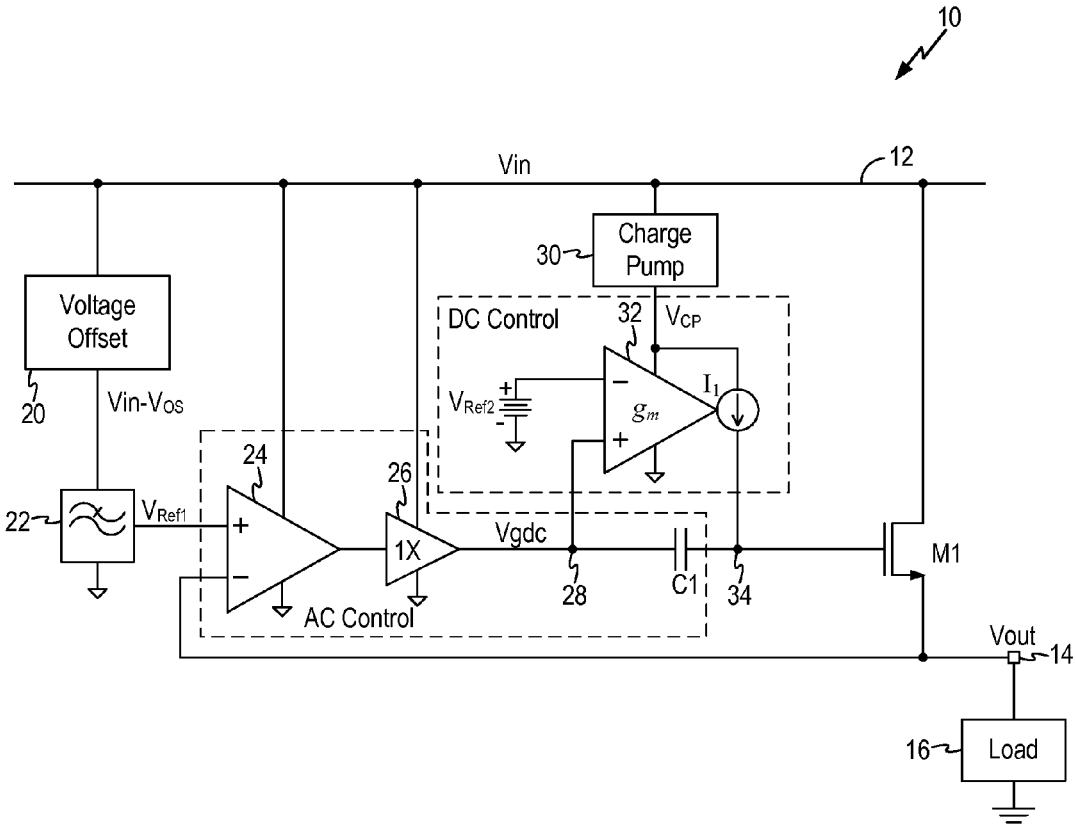
FIG. 1 is a schematic diagram of a voltage regulator with high bandwidth PSRR according to one embodiment of the present invention.

FIG. 1 is a schematic diagram of a voltage regulator with high bandwidth PSRR according to one embodiment of the present invention. Referring to FIG. 1, a voltage regulator 10 receives an input voltage Vin (node 12) and generates a regulated output voltage Vout (node 14) using an NMOS transistor M1 as the power device. More specifically, the drain terminal of the power device M1 receives the input voltage Vin while the source terminal of the power device M1 provides the output voltage Vout. The output voltage Vout may be coupled to drive a load 16. The gate terminal (node 34) of the power device M1 receives a gate drive signal generated by a feedback control loop to modulate the gate voltage of the power device M1 so as to regulate the output voltage Vout.

According to embodiments of the present invention, voltage regulator 10 includes an integrated AC/DC control loop including an AC control portion and a DC control portion. The AC control portion is formed by an operational amplifier 24, a buffer-driver 26 and a capacitor C1. The AC control portion generates both AC and DC control information based on the output voltage Vout and also provides the AC component of the gate drive signal for modulating the gate voltage of the power device M1. The DC control portion is formed by a low power high voltage control amplifier 32 controlling the DC component or DC voltage level of the gate drive signal at the gate terminal 34 of the power device M1.

In voltage regulator 10, the AC control portion is powered from the input voltage Vin. The AC control portion generates AC and DC control information based on the output voltage Vout. The AC control portion also generates the AC component of the gate drive signal which is AC coupled to the gate terminal of the power device M1. Meanwhile, the DC control portion is supplied by a charge pump 30 providing a high supply voltage $V_{CP}$ greater than the input voltage Vin. The DC control portion sets the DC voltage level of the gate drive signal at the gate terminal of the power device M1.

In operation, the AC control portion regulates the output voltage Vout to a first reference voltage $V_{Ref1}$, either directly or through a voltage divider. The AC control portion generates a gate drive control signal Vgdc (node 28) which contains both AC and DC control information for the gate drive signal (node 34). In the AC control portion, the gate drive control signal Vgdc is AC coupled to the gate terminal of the power device M1 as the AC component of the gate drive signal. Meanwhile, the gate drive control signal Vgdc is provided to the DC control portion which operates to regulate the gate drive control signal Vgdc to a second reference voltage $V_{Ref2}$ to set the DC voltage level of the gate drive signal. In this manner, the AC control portion and the DC control portion are integrated in operation with the AC control portion providing the DC information of the output voltage feedback control to the DC control portion.

More specifically, the operational amplifier 24 in the AC control portion receives the output voltage, or a voltage indicative of the output voltage, on its negative input terminal and the first reference voltage $V_{Ref1}$ on its positive input terminal. Operational amplifier 24 generates an output signal indicative of the difference between the output voltage and the first reference voltage $V_{Ref1}$. The output signal of operational amplifier 24 is buffered by the buffer-driver 26 to generate the gate drive control signal Vgdc (node 28). The gate drive control signal Vgdc is then AC coupled through the capacitor C1 to drive the gate terminal 34 of the power device M1. By way of AC coupling, only the AC components of the gate drive control signal Vgdc is passed through capacitor C1 to the gate terminal (node 34) of the power device M1. The DC level of the gate drive control signal Vgdc is blocked by the capacitor C1. The AC control portion therefore provides the AC component of the gate drive signal to the gate terminal of the power device M1.

Meanwhile, the control amplifier 32 in the DC control portion receives the gate drive control signal Vgdc (node 28) generated in the AC control portion on the positive input terminal. The control amplifier 32 also receives the second reference voltage $V_{Ref2}$ on the negative input terminal. The control amplifier 32 is a low power high voltage transconductance amplifier and generates an output current $I_1$ having a current value indicative of the difference between the gate drive control signal and the second reference voltage. The output current $I_1$ drives the gate terminal (node 34) of the power device M1 according to the DC information embedded in the gate drive control signal Vgdc provided by the amplifier 24 and the buffer-driver 26 in the AC control portion. As a result, the control amplifier 32 set the DC voltage level of the gate drive signal. In embodiments of the present invention, the control amplifier 32 has a large gain so that the DC control component of the gate drive control signal Vgdc on node 28 can be small. By using a large gain control amplifier 32 to control the DC voltage level of the gate drive signal, the operational amplifier 24 in the AC control portion can have a large gain as well to realize a large PSRR.

In the AC control portion, both the operational amplifier 24 and the buffer-driver 26 are powered by the input voltage Vin. In the DC control portion, the control amplifier 32 is powered by the charge pump 30 providing a high supply voltage $V_{CP}$. Accordingly, the buffer-driver 26 in the AC control portion is supplied from the capable power supply—the input voltage Vin and not from the charge pump. Thus, the buffer-driver 26 has sufficient power supply for transient corrections and is capable of realizing high frequency performance. Meanwhile, the control amplifier 32 in the DC control portion operates at low frequency and high voltage and requires very low power for operation. Thus, the control amplifier 32 can be supplied by the charge pump 30 capable of providing a high voltage but at low current.

In the embodiment shown in FIG. 1, the output voltage Vout is set to follow the input voltage Vin with a predefined offset. More specifically, the input voltage Vin is fed through a voltage offset circuit 20 to generate an offset input voltage Vin-$V_{OS}$, where $V_{OS}$ is the predefined offset voltage. In one embodiment, the offset voltage $V_{OS}$ is about 150 mV. The offset voltage value is selected to optimize power efficiency while assuring a proper operating condition of power device M1. The offset input voltage Vin-$V_{OS}$ is then supplied to a low pass filter 22 to filter out any high frequency noise that may be present on the offset voltage $V_{OS}$ or the input voltage Vin. In this manner, the low pass filter 22 operates to suppress power supply noise. In one embodiment, the low pass filter 22 blocks the AC components of the offset input voltage with frequency above 1 kHz. The filtered offset input voltage is the first reference voltage $V_{Ref1}$ which is provided to the operational amplifier 24 in the AC control portion. With the first reference voltage $V_{Ref1}$ thus established, the output voltage Vout is regulated to the first reference voltage $V_{Ref1}$ in the AC control portion. Accordingly, the output voltage Vout is regulated to an offset voltage $V_{OS}$ below the input voltage Vin, that is, Vin-$V_{OS}$.

By using a low-pass filtered reference voltage in the AC control portion, the voltage regulator 10 is able to maintain a high level of PSRR for a small voltage drop between the input voltage Vin and the output voltage Vout. Furthermore, the high PSRR is able to be maintained over a wide bandwidth while the voltage regulator consumes only a small amount of ground current, such as about 100 μA.

Figure 2:
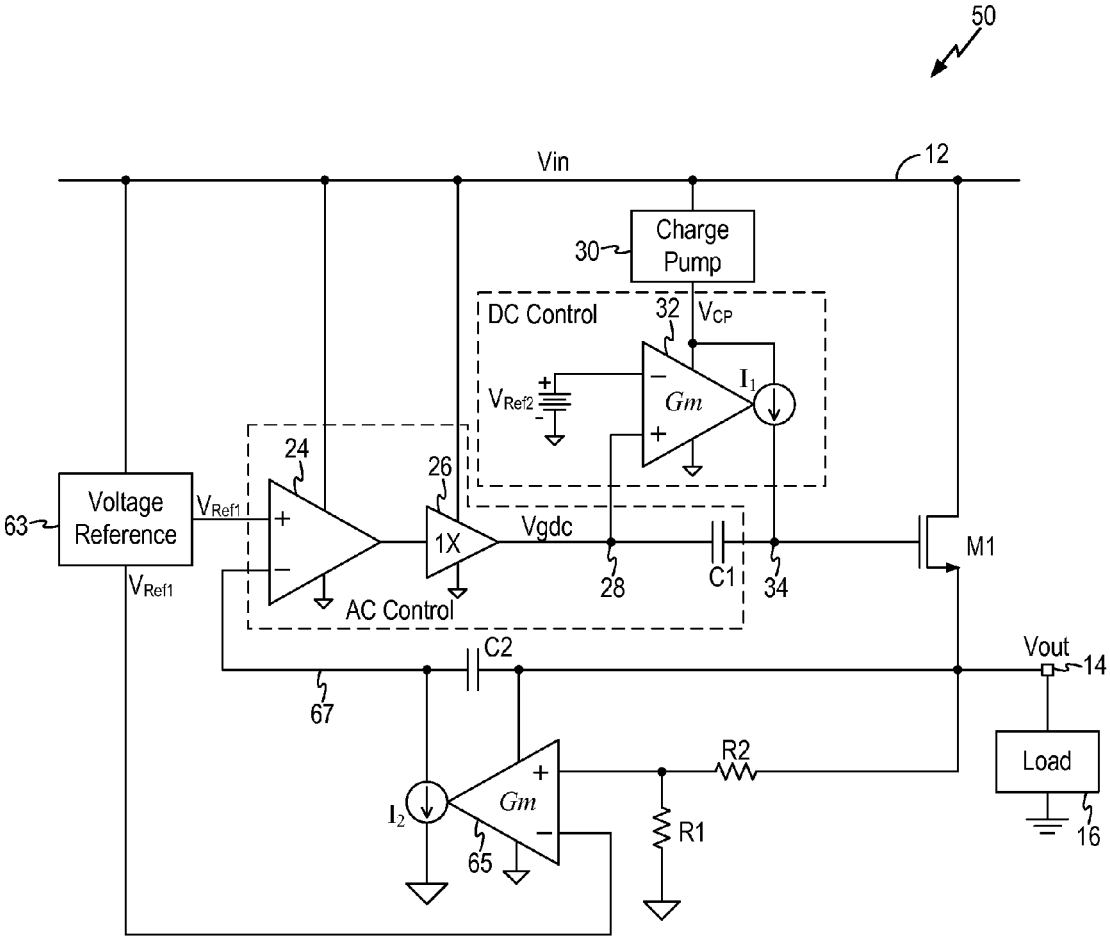
FIG. 2 is a schematic diagram of a voltage regulator with high bandwidth PSRR according to alternate embodiment of the present invention.

FIG. 2 is a schematic diagram of a voltage regulator with high bandwidth PSRR according to alternate embodiment of the present invention. Referring to FIG. 2, a voltage regulator 50 is constructed in a similar manner as voltage regulator 10 of FIG. 1 and includes an integrated AC/DC control loop. However, in the embodiment shown in FIG. 2, the output voltage is regulated to a fixed voltage value defined by the first reference voltage $V_{Ref1}$ and feedback resistors R1 and R2 where the first reference voltage is generated by a voltage reference circuit 63 with inherent power supply rejection characteristic. In some embodiments, the voltage reference circuit 63 is a bandgap reference circuit and the first reference voltage $V_{Ref1}$ is derived from a bandgap reference voltage. In one embodiment, the first reference voltage $V_{Ref1}$ is a divided down voltage value from the bandgap reference voltage of 1.25V.

In voltage regulator 50, the output voltage Vout (node 14) is AC coupled to the negative input terminal (node 67) of the operational amplifier 24 of the AC control portion through a capacitor C2. Thus, only the AC components of the output voltage signal is passed to the negative input terminal (node 67) of the operational amplifier 24. The first reference voltage $V_{Ref1}$, generated by the voltage reference circuit 63, is coupled to the positive input terminal of the operational amplifier 24. The output voltage Vout is also coupled to a resistor divider network formed by resistors R1 and R2 and connected between the output and ground. The divided down output voltage is provided to the positive input terminal of a control amplifier 65 while the first reference voltage $V_{Ref1}$ is coupled to the negative input terminal of the control amplifier 65. In the present embodiment, the control amplifier is implemented as a transconductance amplifier and generates an output current $I_2$ having a current value indicative of the difference between the divided down output voltage and the first reference voltage $V_{Ref1}$. The output current $I_2$ drives the negative input terminal (node 67) of the operational amplifier 24, thereby setting the DC voltage level of the feedback output voltage signal.

After establishing the feedback output voltage at the negative input terminal (node 67) of the operational amplifier 24, the AC and DC control portions in voltage regulator 50 operate in the same manner as voltage regulator 10 in FIG. 1 to control the gate drive signal of power device M1. The voltage regulator 50, using a supply-noise-insensitive reference voltage for the AC/DC control loop, is capable of attenuation factor of about 1000 (60 dB) from 30 kHz to 10 MHz in embodiments of the present invention.

The above detailed descriptions are provided to illustrate specific embodiments of the present invention and are not intended to be limiting. Numerous modifications and variations within the scope of the present invention are possible. The present invention is defined by the appended claims.

We claim:

1. A voltage regulator receiving an input voltage and generating an output voltage, comprising:

a power device comprising an NMOS transistor having a drain terminal coupled to the input voltage, a source terminal providing the output voltage and a gate terminal receiving a gate drive signal; and an integrated AC/DC control loop configured to access the output voltage and to generate the gate drive signal based on a value of the output voltage in relation to a first reference voltage and a second reference voltage, the integrated AC/DC control loop comprising an AC control portion and a DC control portion, wherein:

the AC control portion is configured to access a difference between a voltage indicative of the output voltage and the first reference voltage, the AC control portion generating a gate drive control signal, the gate drive control signal being AC coupled to the gate terminal of the power device, an AC component only of the gate drive control signal being coupled to the gate terminal of the power device as an AC component of the gate drive signal, the AC control portion being powered by the input voltage, wherein the voltage regulator further comprises a voltage offset circuit configured to receive the input voltage and to generate an offset input voltage, the offset input voltage being the input voltage decreased by an offset voltage, and the voltage regulator further comprises a low pass filter configured to filter the offset input voltage to remove high frequency noise and to provide a filtered offset input voltage as the first reference voltage to the AC control portion; and the DC control portion is configured to access a difference between the gate drive control signal and the second reference voltage, the DC control portion controlling a DC voltage level only of the gate drive signal at the gate terminal of the power device, the DC control portion being powered by a high supply voltage greater than the input voltage.

2. The voltage regulator of claim 1, wherein the AC control portion comprises:

an operational amplifier having a positive input terminal receiving the first reference voltage, a negative input terminal receiving the voltage indicative of the output voltage, and an output terminal generating an output signal indicative of the difference between the voltage indicative of the output voltage and the first reference voltage;

a buffer-driver circuit receiving the output signal of the operational amplifier and generating the gate drive control signal; and a first capacitor having a first electrode coupled to receive the gate drive control signal and a second electrode coupled to the gate terminal of the power device, the gate drive control signal being AC coupled through the first capacitor to the gate terminal of the power device, wherein the operational amplifier and the buffer-driver circuit are powered by the input voltage.

3. The voltage regulator of claim 1, wherein the DC control portion comprises:

a control amplifier having a positive input terminal receiving the gate drive control signal, a negative input terminal receiving the second reference voltage and an output terminal generating an output signal indicative of the difference between the gate drive control signal and the second reference voltage, the output signal of the control amplifier being coupled to the gate terminal of the power device to control the DC voltage level of the gate drive signal, wherein the control amplifier is powered by the high supply voltage greater than the input voltage.

4. The voltage regulator of claim 1, wherein the voltage indicative of the output voltage is the output voltage itself.

5. The voltage regulator of claim 1, wherein the first reference voltage is derived from a third reference voltage having inherent power supply rejection characteristic.

6. The voltage regulator of claim 3, further comprising a charge pump configured to receive the input voltage and generate the high supply voltage to supply the control amplifier.

7. The voltage regulator of claim 3, wherein the control amplifier comprises a transconductance amplifier, the output signal of the control amplifier being an output current signal, the output current signal being configured to drive the gate terminal of the power device to set the DC voltage level of the gate drive signal.

8. The voltage regulator of claim 5, wherein the third reference voltage having inherent power supply rejection characteristic comprises a bandgap reference voltage and the first reference voltage is derived from the bandgap reference voltage.

9. The voltage regulator of claim 5, wherein the voltage indicative of the output voltage being coupled to the AC control portion comprises a feedback output voltage, the voltage regulator further comprising:

a second capacitor having a first electrode coupled to the output voltage and a second electrode coupled to the AC control portion, the output voltage being AC coupled through the second capacitor to an input node of the AC control portion as the AC component of the feedback output voltage;

a voltage divider configured to receive the output voltage and to generate a divided-down output voltage; and a second control amplifier having a positive input terminal receiving the divided-down output voltage, a negative input terminal receiving the first reference voltage, and an output terminal generating an output signal indicative of a difference between the divided-down output voltage and the first reference voltage, the output signal of the second control amplifier being coupled to the input node of the AC control portion to control the DC voltage level of the feedback output voltage.

10. The voltage regulator of claim 9, wherein the second control amplifier comprises a transconductance amplifier, the output signal being an output current signal, the output current signal being configured to drive the input node in the AC control portion to set the DC voltage level of the feedback output voltage.

* * * * *